US005502841A

United States Patent [19]

Stanford

[11] Patent Number: 5,502,841

[45] Date of Patent: Apr. 2, 1996

[54] BOXING GLOVE

[76] Inventor: Albert Stanford, P O Box 155, Marikana 0284, South Africa

[21] Appl. No.: 223,579

[22] Filed: Apr. 6, 1994

[30] Foreign Application Priority Data

Apr. 8, 1993 [ZA] South Africa ..... 92/9460

[51] Int. Cl.[6] ..... A41D 13/10; G01D 11/00; A63B 69/34

[52] U.S. Cl. ..... 2/18; 116/200; 116/212; 482/84

[58] Field of Search ..... 2/16, 18, 161.1; 116/222, 200, 203, 212; 33/666; 482/83, 84, 86

[56] References Cited

U.S. PATENT DOCUMENTS

| | | | |
|---|---|---|---|
| 421,447 | 2/1890 | Stewart | 2/18 |
| 955,136 | 4/1910 | Cline | 2/18 |
| 4,653,582 | 3/1987 | Ehrenfried | 2/16 X |
| 5,323,494 | 6/1994 | Weimer | 2/431 X |

*Primary Examiner*—Paul C. Lewis
*Attorney, Agent, or Firm*—Peter L. Michaelson

[57] ABSTRACT

A boxing glove including an impact reducing mechanism which can assist in minimising of some injury during boxing. The boxer's fist is movable within the coveting defining the fist space and movable between the rear and front positions when the front of the boxing glove strikes a target. The impact reducing mechanism includes a first part, preferably in the form of a rectangular plate, and a resilient means, preferably including at least one elastic band, which operatively interconnects the plate to the covering. The plate is forwardly displaceable via the forward moving fist between an inoperative position and an operative position when the front of the boxing glove strikes the target. The plate thus acts against the elastic band. After the front of the glove has lost contact with the target, the elastic band allows the plate to be in the inoperative position. Preferably, the impact reducing mechanism includes a frame in the fist space said frame attached to the inside of the covering. The at least one elastic band extends across the front surface of the plate and operatively attaches the plate to the frame. Preferably, a gripping member to be gripped by the fist is attached to the plate. The glove further includes a target marking means for marking the target during boxing. The marking means is partially located in the front of the boxing glove and interconnected with the plate.

17 Claims, 9 Drawing Sheets

243
18
212
202
20
221
204
226
10
224
222
232
12
222
244
206
232
216
246
207
30
210
208
220
135
135
28.3
122
120
215
28.1
135
236
DI
135
24.3
DI
26.4
AF
26.5
24.2
AF
CI
CI
26.3
26.2
139.1
138
24.1
BI
14
BI
135
162
135
139.2
160
22
26.1
AR
28
AR
50
51.1
136
142
66
306
300

302
54

BOXING GLOVE

BACKGROUND OF THE INVENTION

1. Field of the Invention

This invention relates to a boxing glove and more particularly to a boxing glove designed in such a manner so that the impact, when the front of the glove strikes a target, for example an opponent, is not that severe or is drastically reduced. The invention extends to the boxing glove having a target marking means which enables a boxer to identify where he has struck the target.

2. Description of Related art

Boxers, especially beginners and other persons taking up boxing for recreation, use conventional type boxing gloves also used by more experienced boxers. A shortcoming of these conventional boxing gloves is that the impact, when the front of the boxing glove strikes the target, for example the opponent, particularly, his head, is quite severe. It will thus be appreciated that such an impact can be quite painful and, of course, also cause rather painful injuries, for example, to the head and body of the opponent being struck and/or to the hand of the boxer delivering the blow. Due to this shortcoming the applicant has experienced that some beginners and some of the recreational boxers have lost interest in taking up and continuing boxing. Beginners who may be potential champion boxers thus turn themselves away from further boxing, at least at a competitive level. It will further be understood that more experienced boxers may also benefit from using the boxing glove of the present invention.

Further, the applicant has found that a need exists for a boxing glove comprising a target marking means which enables a boxer to identify where he has struck his opponent. In this way the boxer, especially the boxer in training, can direct his blows to a specific area on the body of the opponent and afterwards study his success rate in striking that area.

The applicant is aware of a prior art target marking means or indicator as disclosed in U.S. Pat. No. 4,653,582 in the name of Treco Products, Inc.. During use, the indicator is transferred from a participant's glove to an opponent at the point of contact. The indicator thus does not form an integral part of the glove which means that there is a possibility that the indicator can get lost. A further shortcoming of that invention arises when successive hits are to be marked on the opponent. Said patent teaches that this could be accomplished by stacking several indicators one on top of another on the participant's equipment the indicators to be sequentially transferred. The patent, however, does not describe in detail how this will be successfully accomplished. The applicant foresees the possibility of more than one indicator at a time being transferred.

OBJECTS AND SUMMARY OF THE INVENTION

It is an object of the present invention to provide a boxing glove which includes an impact reducing mechanism to reduce the impact of a blow during boxing.

A related object to the aforegoing is to provide a boxing glove which includes a target marking means which forms part of the boxing glove and which is rendered operative by the impact reducing mechanism.

According to the present invention there is provided a boxing glove which includes:

a covering defining a fist space which fist space allows a fist to be movable forwardly therein between a rear position and a front position when the front of the boxing glove strikes a target; and an impact reducing mechanism including:

a frame which is generally located in the fist space and being attached to an inside of the covering;

resilient means being operatively connected to the frame; and a first part being arranged in the fist space and being operatively connected to the frame by the resilient means to be in the way of the forwardly moving fist when the front of the boxing glove strikes the target, the first part being displaceable by the forwardly moving fist against the bias of the resilient means towards an operative position and being displaceable back towards its original position under the influence of the resilient means.

It is a preferred feature of the invention that the resilient means includes at least one elastic band which operatively interconnects the first part to the frame.

It is a further preferred feature that the impact reducing mechanism includes a gripping member attached to the first part which gripping member is to be gripped by a fist.

Preferably, one of the frame and the inside of the covering is provided with a male stud and the other one of the frame and the inside of the covering is provided with a female stud, the male and female studs co-acting with each other to attach the frame to the inside of the covering in a removable manner to allow the impact reducing mechanism to be removable from the boxing glove to allow for repairs to the impact reducing mechanism.

Preferably, the first part is in the form of a plate which is located between the rear position of the fist and the front of the boxing glove and across the width of the boxing glove. The plate may be kept in position by means of cords which extend between a front of the frame near the front of the boxing glove and the plate each of the cords suitably knotted to the plate and the front of the frame.

In an embodiment of the invention the at least one elastic band extends over the front surface of the plate, over two opposite edges of the plate and then towards a rear end of the frame the ends of the at least one elastic band suitably attached to the rear end of the frame. The plate may be provided with two slots one slot next to and generally parallel to a first of the edges and the other slot next to and generally parallel to a second of the edges the at least one elastic band extending through the slots.

In another embodiment of this invention the frame includes two strips opposite each other extending from the front of the frame towards the rear position of the fist a first end of the elastic band suitably attached to a rear end of a first of the strips and a second end of the elastic band suitably attached to a rear end of a second of the strips.

In the embodiment mentioned in the previous paragraph the boxing glove includes two pouches, a first pouch fitting over the rear end of the first strip and a second pouch fitting over the rear end of the second strip, with the first end of the elastic band attached to the first pouch and the second end of the elastic band attached to the second pouch.

It is preferred that the impact reducing mechanism is removable from the boxing glove to allow for repairs to the impact reducing mechanism.

In a preferred embodiment of this invention the impact reducing mechanism includes:

a gripping member and a plurality of first parts in the form of a front plate, an intermediate plate and a rear plate the gripping member attached to the rear plate and to be gripped by the fist, the three plates spaced from and generally parallel to each other and across the width of the fist space, the front plate located towards the front of the boxing glove, the rear plate located towards and in front of the rear position of the fist, the intermediate plate located between the front and the rear plates, and the resilient means includes a plurality of elastic bands each of said three plates operatively attached to the frame by means of at least one elastic band, each of said three plates displaceable by means of the forward moving fist between an inoperative position and an operative position when the front of the boxing glove strikes the target, the fist movement causing the three plates to co-act with its associated at least one elastic band which elastic band displaces its associated plate to its inoperative position after the front of the boxing glove has lost contact with the target and which resilient means allows the fist to be in the rear position after the front of the boxing glove has lost contact with the target.

The present invention extends to the boxing glove which further includes a target marking means at least partially located in the front of the boxing glove and interconnected with the first part of the impact reducing mechanism the target marking means caused to be actuated by the forward movement of the first part when the forward moving fist displaces the first part to its operative position.

Preferably, the impact reducing mechanism and the target marking means form a unit which is removable from the boxing glove to allow for repairs to the unit.

Further, preferably, the target marking means includes a tensioned resilient means and a piece of foam rubber which piece of foam rubber is located within an opening formed in the covering the piece of foam rubber interconnected with the first part and the resilient means operatively interconnecting the piece of foam rubber with the coveting which tensioned resilient means displaces a front of the foam rubber from the opening when the forward moving fist displaces the first part to its operative position. It is preferred that the tensioned resilient means includes at least one elastic band.

The piece of foam rubber is, preferably, located within an opening in an outer piece of foam rubber which outer piece of foam rubber snugly fits in an opening in the front of the boxing glove to form part of the coveving.

In an advantageous embodiment the tensioned resilient means operatively interconnects the piece of foam rubber to the outer piece of foam rubber.

BRIEF DESCRIPTION OF THE DRAWINGS

The invention will now be more fully described, by way of example, with reference to the accompanying drawings in which.

DESCRIPTION OF THE PREFERRED EMBODIMENT

Figure 1:
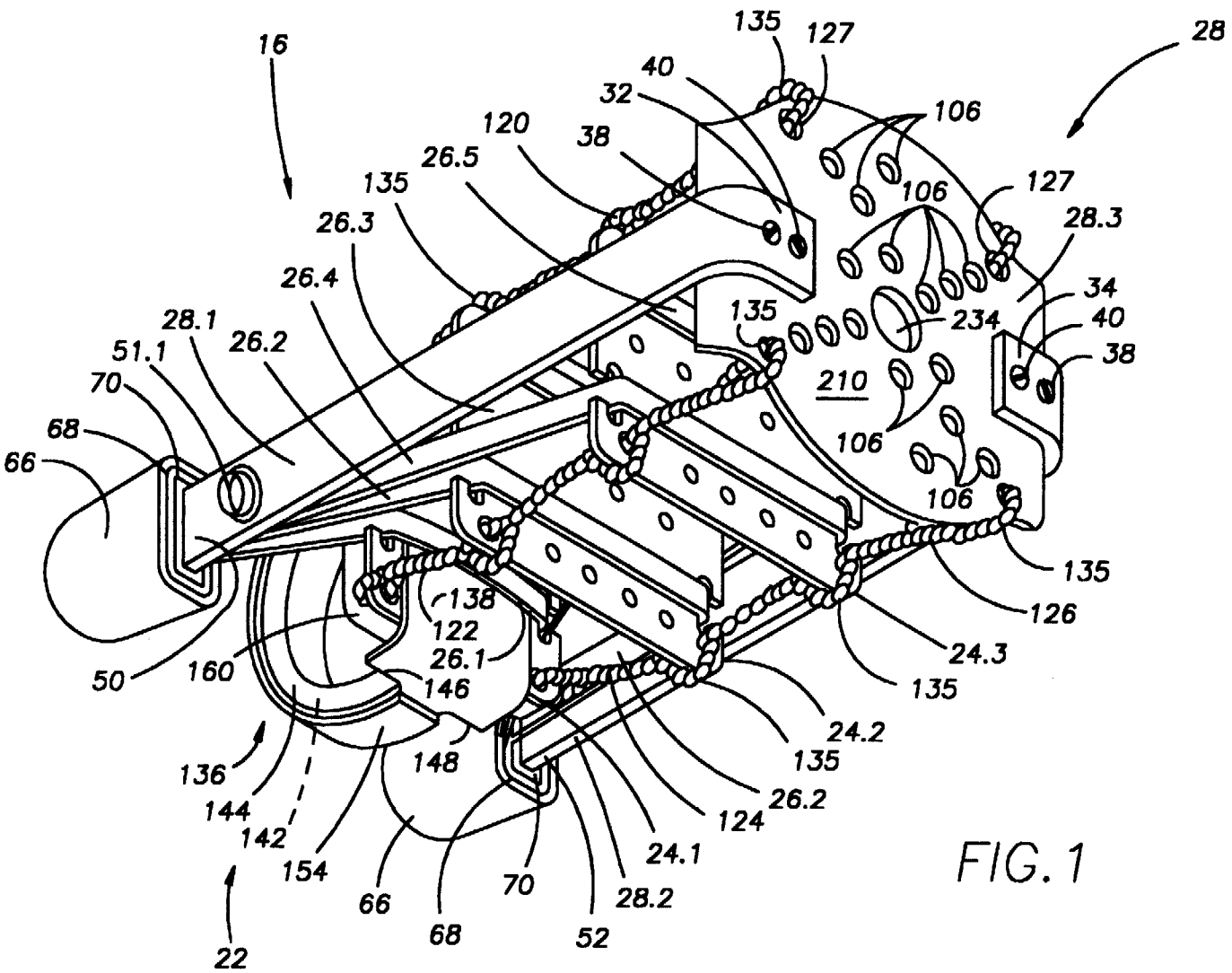
FIG. 1 is a pictorial view of an impact reducing mechanism in accordance with a preferred embodiment of the present invention.
Figure 2:
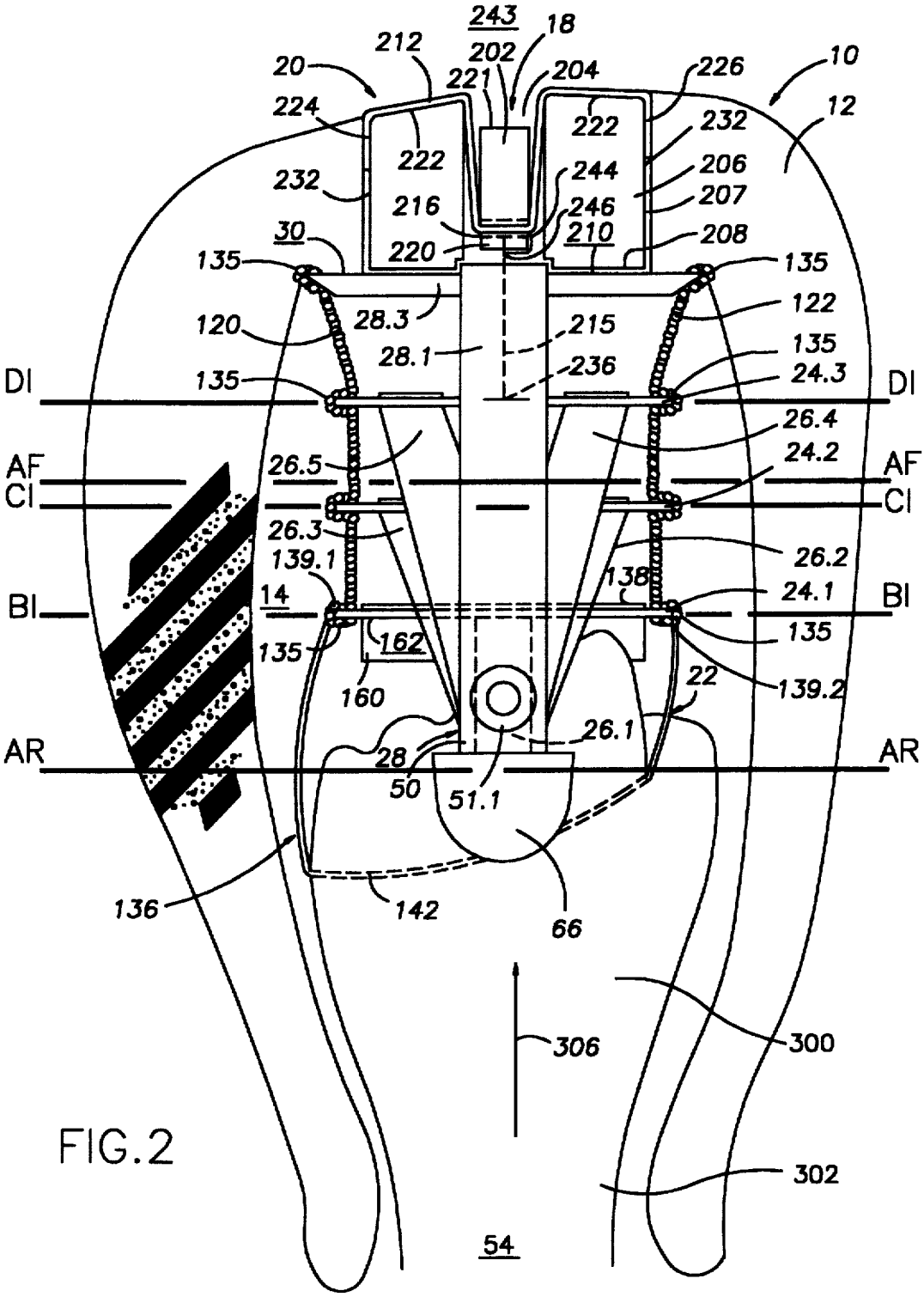
FIG. 2 is a part sectional view through a boxing glove of the present invention with a side view of the impact reducing mechanism shown in FIG. 1 arranged on the inside of the boxing glove and a plan view of a fist gripping a gripping member of the impact reducing mechanism.
Figure 3:
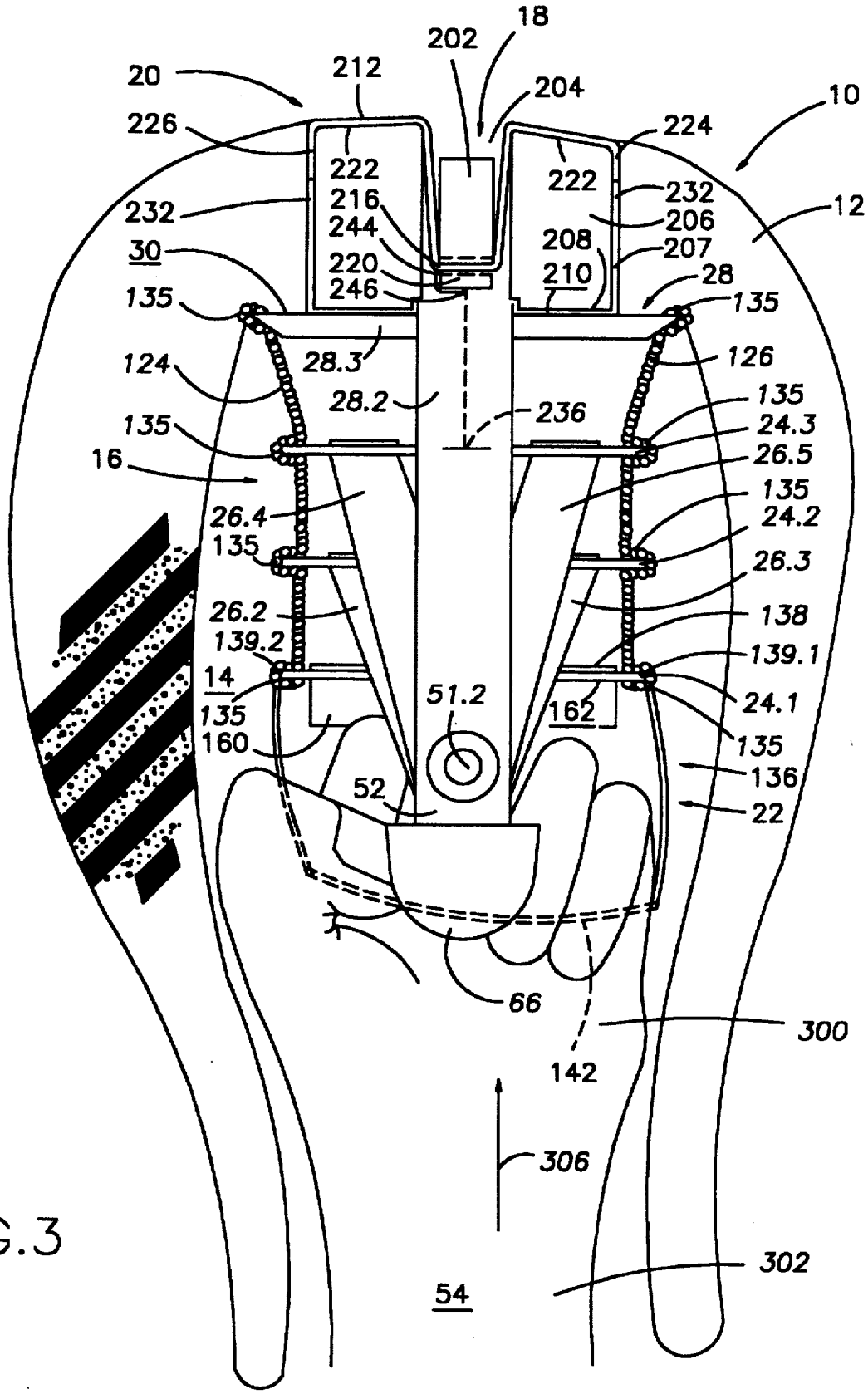
FIG. 3 is an opposite side view of the impact reducing mechanism and a bottom view of the fist shown in FIG. 2.
Figure 4:
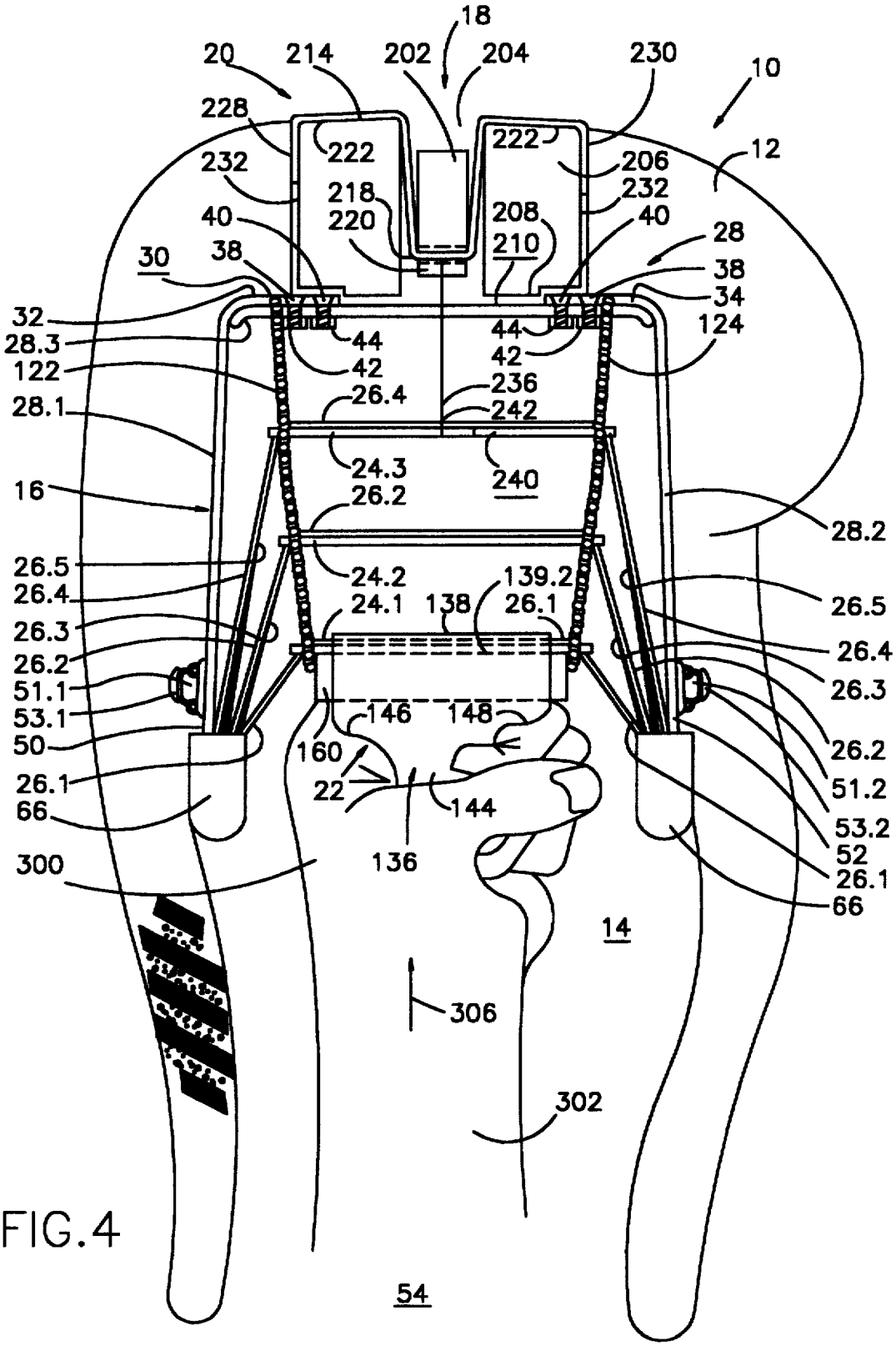
FIG. 4 is a front view of the impact reducing mechanism and a side view towards the thumb of the fist shown in FIGS. 2 and 3.
Figure 5:
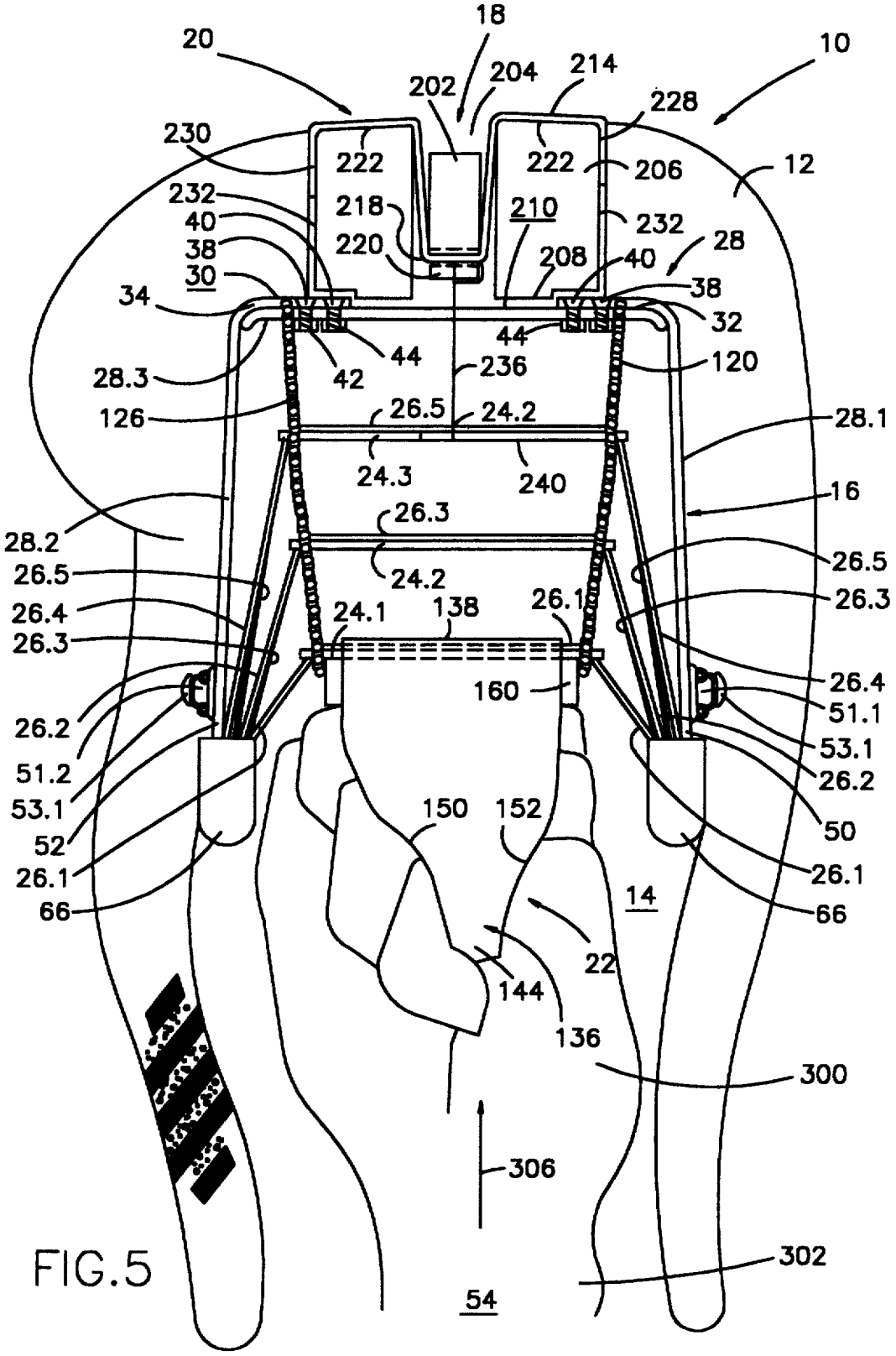
FIG. 5 is a rear view of the impact reducing mechanism and a side view towards the little finger of the fist shown in FIGS. 2, 3 and 4.

Referring to FIGS. 2 to 6 reference numeral 10 generally indicates a preferred embodiment of a boxing glove of the present invention.

The boxing glove 10 includes a covering 12 which defines a fist space 14, an impact reducing mechanism 16 generally located in the fist space 14 and a target marking means 18 at the front 20 of the boxing glove 10.

The impact reducing mechanism 16 includes a gripping member 22 and a plurality of first parts in the form of three small, generally rectangular aluminium plates namely a rear plate 24.1, an intermediate plate 24.2 and a front plate 24.3 successively located in front of the gripping member 22 the plates 24.1, 24.2, 24.3 generally parallel to each other and across the width of the fist space 14. The impact reducing mechanism further includes resilient means in the form of five elastic bands 26.1, 26,2, 26.3, 26.4, 26.5 which interconnect the three plates 24.1, 24.2, 24.3 to the coveving 12.

The impact reducing mechanism 16 further includes a frame 28 located in the fist space 14 and arranged as shown. The interconnection mentioned in the previous paragraph is accomplished by means of the frame 28. The frame 28 which is made of aluminium includes two side strips 28.1, 28.2 opposite each other and an interconnecting front plate 28.3. The front plate 28.3 is located against an inside surface 30 of the coveting 12. Each of the bent over front ends 32, 34 of the two side strips 28.1, 28.2 is suitably attached to the front surface 36 of the front plate 28.3 by means of two screws 38, 40 and two nuts 42, 44. The respective screws 38, 40 extend through respective aligned holes in each of the front ends 32, 34 and front plate 28.3. The respective rear ends 50, 52 of the two side strips 28.1, 28.2 extends towards an opening 54 of the boxing glove 10. Each rear end 50, 52 of the two side strips 28.1, 28.2 is provided with a male stud 51.1, 51.2 which respectively co-acts with a female stud 53.1, 53.2 provided on the inside of the covering 12. In this manner the frame 28 is attached to the inside of the covering 12.

Figure 11:
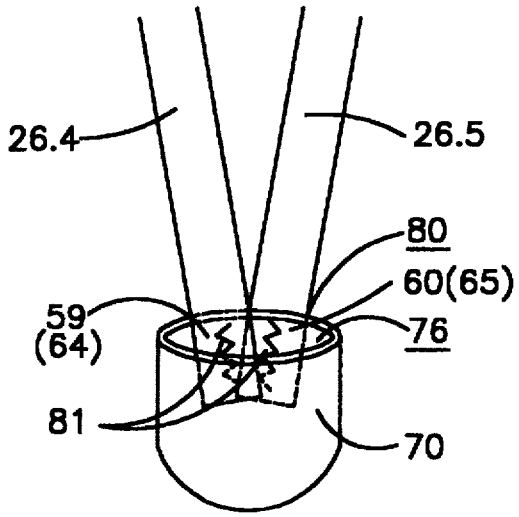
FIGS. 11 and 12 each shows a side view of an attachment of ends of elastic bands of the impact reducing mechanism to a pouch.
Figure 12:
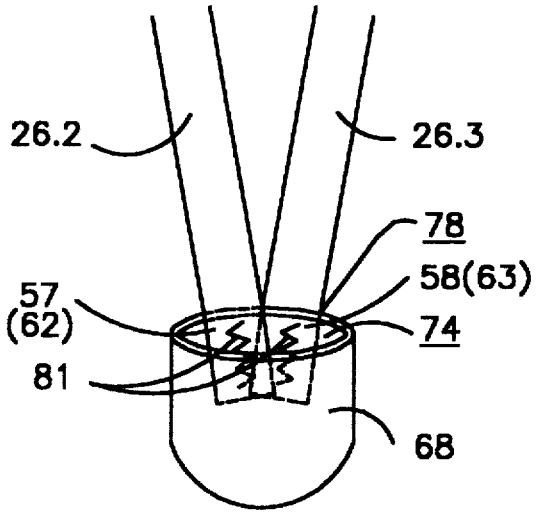
Figure 13:
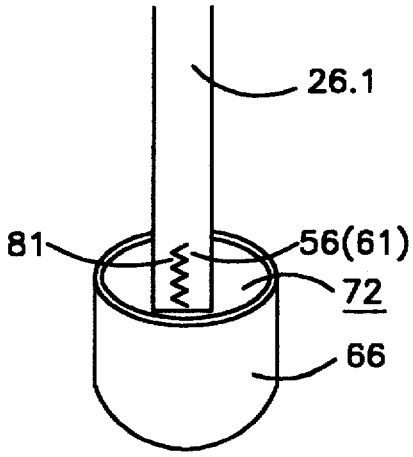
FIG. 13 is a side view of an attachment of an end of an elastic band of the impact reducing mechanism to a pouch.

Five ends 56, 57, 58, 59, 60 of the elastic bands 26.1, 26.2, 26.3, 26.4, 26.5 are attached to the rear end 50 of the side strip 28.1. The opposite other five ends 61, 62, 63, 64, 65 of the elastic bands 26.1, 26.2, 26.3, 26.4, 26.5 are attached to the rear end 52 of the side strip 28.2. The attachments may be effected in any suitable manner. In this embodiment the ends 56, 57, 58, 59, 60, 61, 62, 63, 64, 65 are respectively sewn to leather pouches which fit over the rear ends 50, 52 of the two side strips 28.1, 28.2. Three leather pouches 66, 68, 70 are shown in FIGS. 11, 12 and 13 with the ends 56, 57, 59 sewn onto the insides 72, 74, 76 of the respective pouches 66, 68, 70 and the ends 58, 60 sewn onto the outsides 78, 80 of the respective pouches 68, 70. The stitches are generally indicated by the reference numeral 81. A similar arrangement in which the other three pouches are used is applicable to the opposite ends 61, 62, 63, 64, 65 last-mentioned reference numerals shown in brackets in FIGS. 11, 12, 13 for ease of reference. In the attachments shown in FIGS. 1 to 6, the rear end 50 of the side strip 28.1 fits into the pouch 70, the pouch 68 fits over the pouch 70 and the pouch 66 over the pouch 68. Of course, the pouch 70 is the smallest of the pouches 66, 68, 70, the pouch 66 the largest and the pouch 68 having an intermediate size. The attachment of pouches over the rear end 52 of the side strip 28.2 has a similar arrangement, but with a mirror image.

Figure 7:
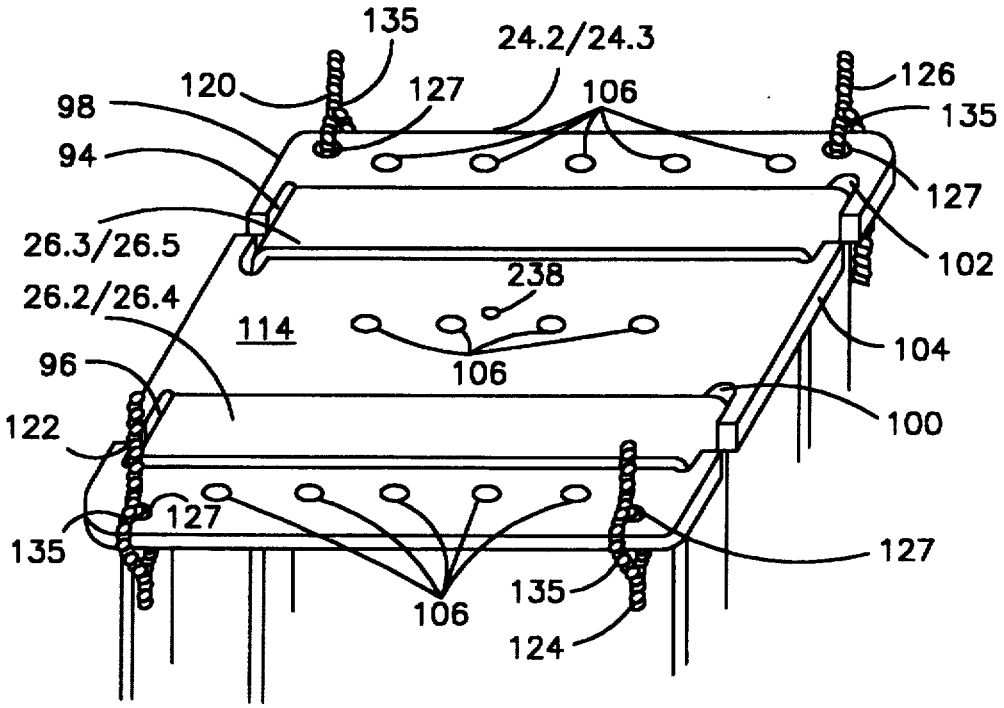
FIG. 7 is an oblique view generally showing a front/intermediate plate of the impact reducing mechanism.
Figure 8:
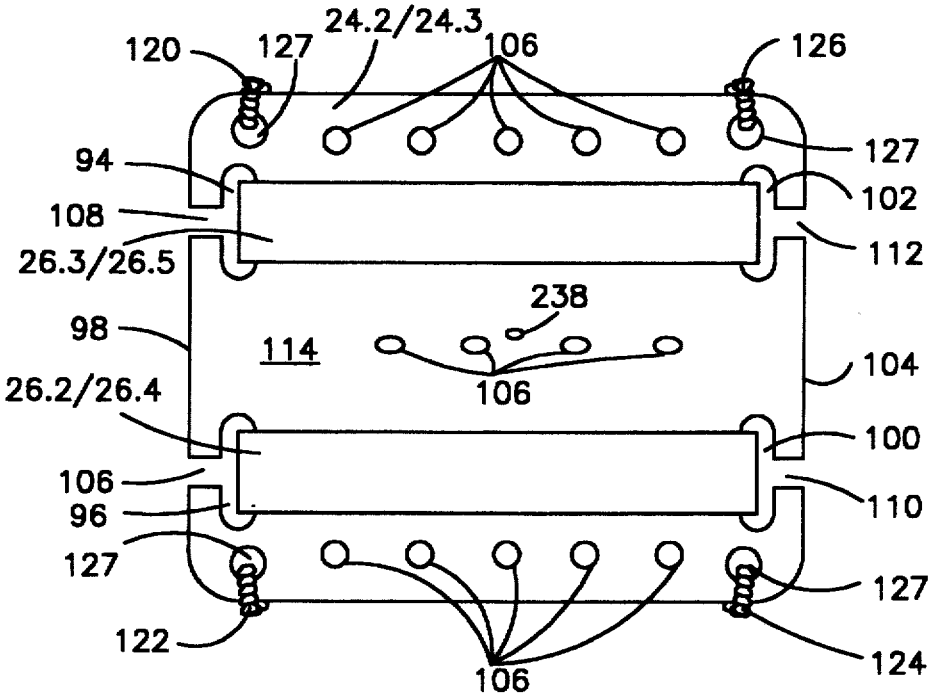
FIG. 8 is a plan view of the font/intermediate plate shown in FIG. 7.
Figure 10:
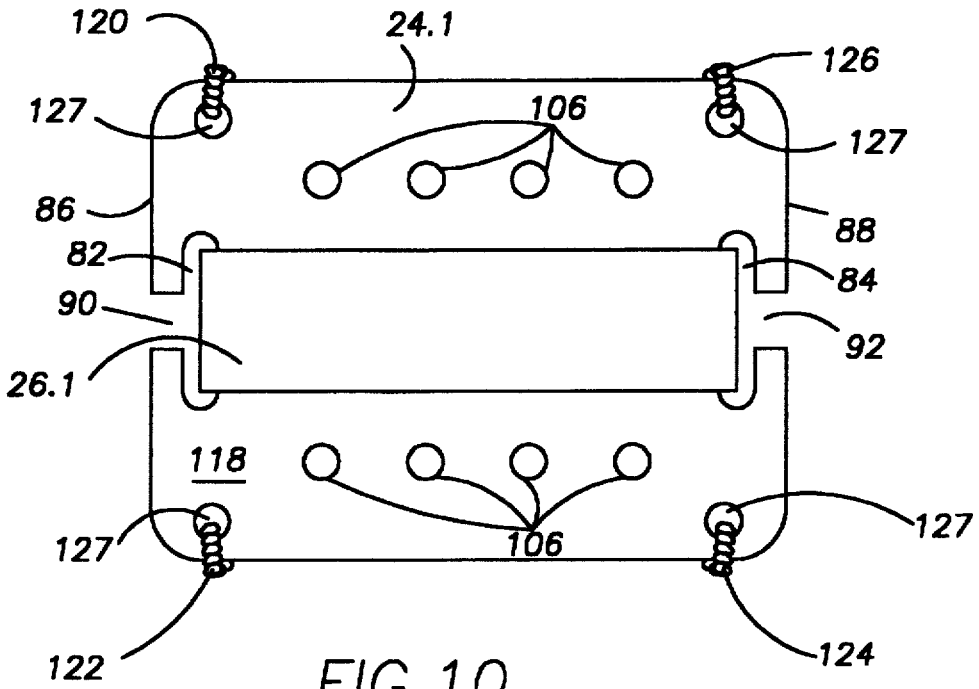
FIG. 10 is a plan view of the rear plate shown in FIG. 9.
Figure 9:
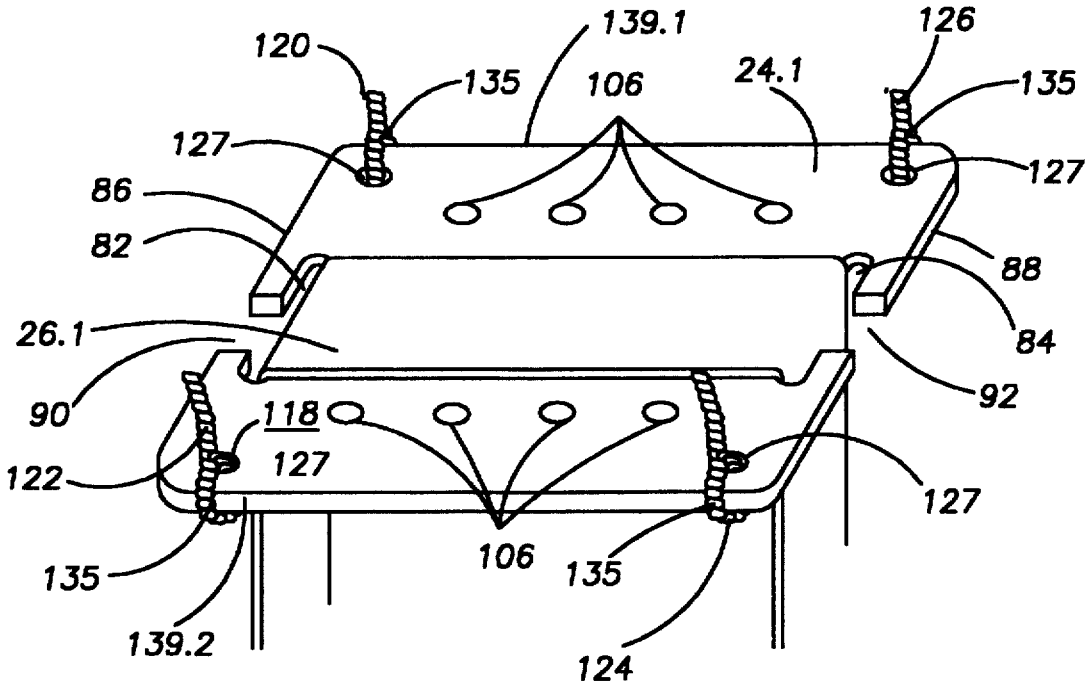
FIG. 9 is an oblique view of a rear plate of the impact reducing mechanism.

Reference is now made to FIGS. 7, 8, 9 and 10. The rear plate 24.1 has two opposite slots 82, 84 through it next to and generally parallel to its respective edges 86, 88. A gap 90, 92 in the edge 86, 88 provides access to the slot 82, 84. The intermediate and front plates 24.2, 24.3 are generally the same except that intermediate plate 24.2 is smaller than the front plate 24.3. FIGS. 7 and 8 thus, generally, represents both the front and intermediate plates 24.2, 24.3. Two slots 94, 96 are provided next to and generally parallel to the edge 98 and two slots 100, 102 next to and generally parallel to the edge 104. Gaps 106, 108, 110, 112 in the respective edges 98, 104 provide access to the respective slots 94, 96, 100, 102. Each of the plates 24.1, 24.2, 24.3, 28.3 are provided with a plurality of generally similar holes 106 through it to render the plates 24.1, 24.2, 24.3 lighter.

The two elastic bands 26.4, 26.5 extend over the front surface 114 of the front plate 24.3 and respectively through the slots 94, 96, 100, 102 downwards towards the rear ends 50, 52 of the two side strips 28.1, 28.2 where they are attached as explained earlier. A similar arrangement is applicable to the two elastic bands 26.2, 26.3 which extends over the surface 114 of the intermediate plate 24.2 through the slots 94, 96, 100, 102 downwards towards the rear ends 50, 52 of the two side strips 28.1, 28.2 where they are attached as explained earlier. The one elastic band 26.1 extend over the surface 118 of the rear plate 24.1 through the slots 82, 84 downwards towards the rear ends 50, 52 of the two side strips 28.1, 28.2 where they are attached as explained earlier. The respective gaps 90, 92, 106, 108, 110, 112 in the rear, intermediate and front plates 24.1, 24.2, 24.3 allow the respective elastic bands 26.1, 26.2, 26.3, 26.4, 26.5 to be inserted into the respective slots 82, 84, 94, 96, 100, 102.

The three plates 24.1, 24.2, 24.3 are kept spaced from each other by means of four cords 120, 122, 124, 126 each of which extends from the interconnecting front plate 28.3 of the frame 28, through the front and intermediates plates 24.2, 24.3 to the rear plate 24.1. More particularly, the respective cords 120, 122, 124, 126 are knotted to the respective plates 24.1, 24.2, 24.3, 28.3 through holes 127 close to their respective corners. The knots are generally indicated by the reference numeral 135.

The gripping member 22 which is associated with the rear plate 24.1 includes an endless leather strap 136 of which a front part 138 is glued onto the front surface 118 of the rear plate 24.1 and extends over and beyond both the edges 139.1, 139.2 which are perpendicular to the edges 86, 88 of the rear plate 24.1. The gripping member 22 further includes a bent aluminium strip 142 enclosed by a rear part 144 of the strap 136. More particularly, four cuts have been made into the strap 136 to form the edges 146, 148, 150, 152 and the rear part 144 is then folded around and glued to the aluminium strip 142. An elastic band 154 is attached to the rear part 144 to ensure a better grip. A rectangular piece of foam rubber 160 is glued to the rear surface 162 of the rear plate 24.1.

FIGS. 2, 3, 4, 5 and 6 show that the boxing glove 10 further includes a target marking means 18 at the front 20 and generally located in the coveving 12.

Figure 6:
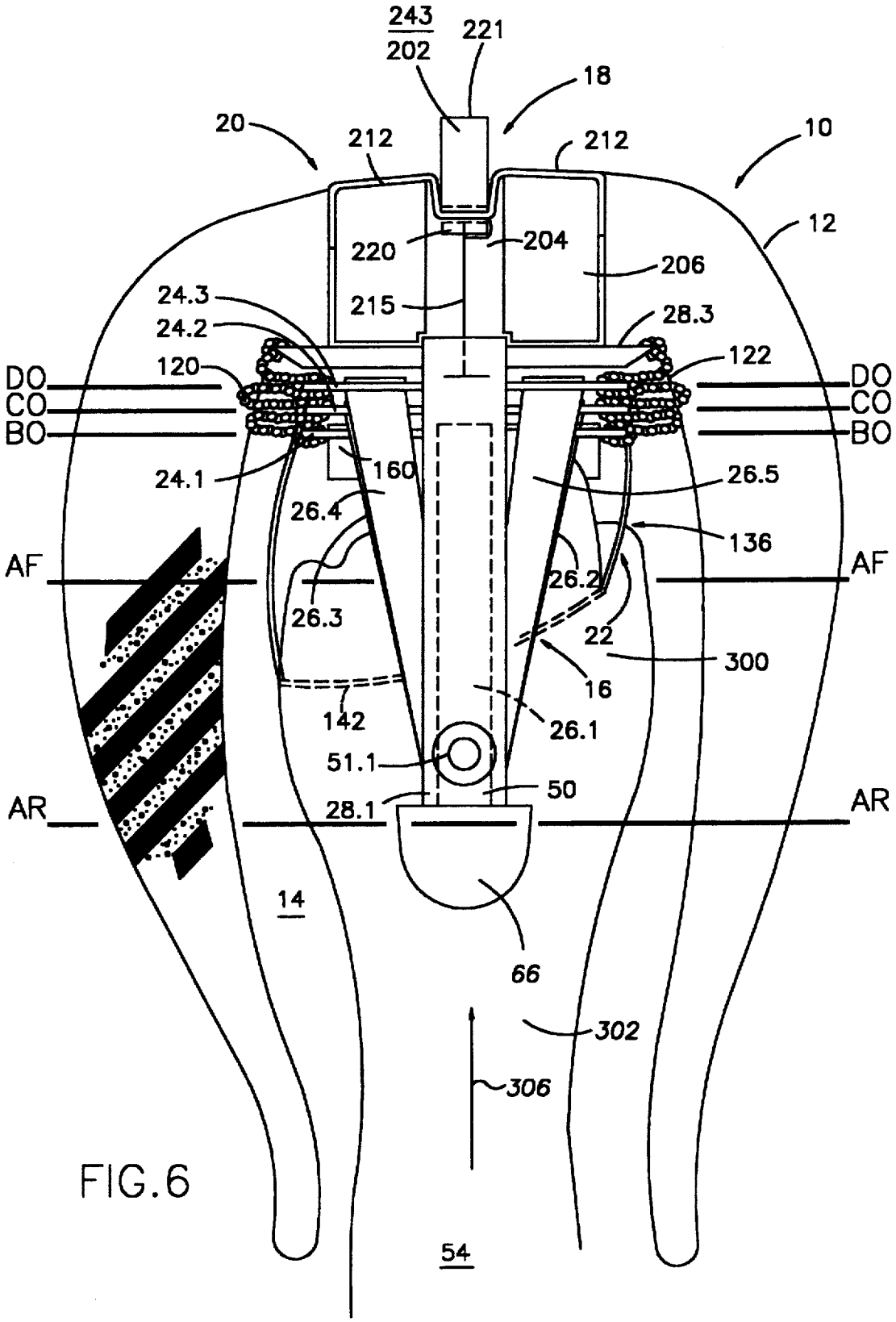
FIG. 6 is the same view as shown in FIG. 2, but with the impact reducing mechanism in an operative condition.

FIGS. 2 to 5 show the target marking means 18 in its inoperative position while FIG. 6 shows the operative position.

The target marking means 18 includes a generally cylindrical inner piece of foam rubber 202 located within an opening 204 through a generally cylindrical outer piece of foam rubber 206. The outer piece of foam rubber 206 fits snugly in an opening 207 in the front 20 of the boxing glove 10 so that the outer piece of foam rubber 206 generally forms part of the covering 12. The rear 208 of the outer piece of foam rubber 206 is glued onto the front surface 210 of the interconnecting front plate 28.3 of the frame 28. The inner piece of foam rubber 202 is kept in position by a tensioned resilient means including two elastic bands 212, 214 and an elongate, flexible member in the form of a cord 215. Each elastic band 212, 214 extends through a hole 216, 218 provided through the rear 220 of the inner piece of foam rubber 202. The holes 216, 218 are orthogonal to and intersect each other. The elastic bands 212, 214 extend upwardly in the opening 204 to the front 221 of the inner piece of foam rubber 202 and then over the front 222 of the outer piece of foam rubber 206. The four ends 224, 226, 228, 230 of the elastic bands 212, 214 are suitably attached to the side 232 of the outer piece of foam rubber 206 for example by stitching.

The cord 215 extends through a hole 234 in the interconnecting front plate 28.3. The rear end 236 of the cord 215 is suitably attached to the front plate 24.3. For example, the rear end 236 may extend through a hole 238 in the front plate 24.3 along the rear surface 240 of the front plate 24.3 and through an adjacent hole 106 in the front plate 24.3 and back to the cord 215 to which it is knotted at 242. The front end 244 of the cord 215 extends through the hole 216 in the inner piece of foam rubber 202 and is knotted to the cord 215 at 246.

When the target marking means 18 is inoperative the two elastic bands 212, 214 are under tension which tend to displace the inner piece of foam rubber 202 towards the outside 243 of the boxing glove 10. The cord 215, however, keeps the inner piece of foam rubber 202 in place.

It will be understood that the unit including the impact reducing mechanism 16 and the target marking means 18 can be removed from the inside of the boxing glove 10 by firstly unclipping the respective studs 51.1, 53.1, 51.2, 53.2 and subsequently pulling the unit 10 to the outside through the opening 54. Necessary repairs and replacement to and of parts can thus be done on the outside of the boxing glove 10. Of course, any laces (not shown) for fastening the boxing glove 10 to a wrist of a boxer must be suitably unfastened or slackened before removal of the unit.

In order to use the boxing glove 10 of this invention a hand is inserted through the opening 54 into the fist space 14 and the enclosed aluminium strip 142 of the gripping member 22 gripped and a fist 300 formed as shown in FIGS. 2 to 6. The boxing glove 10 is suitably fastened around the wrist 302 with lace (not shown) forming part of the boxing glove 10. Note that a left fist 300 is shown in the FIGS. 2 to 6. The fight fist (not shown) is to be inserted into a similar boxing glove 10. Boxing may then commence.

During boxing, when the front 20 of the boxing glove 10 strikes a target (not shown), typically the head or body of an opponent, the front 20 generally stops against the target, but the fist 300, which is movable within the fist space 14, moves forward in the direction of the arrow 306 towards the target. Should the target be struck by a severe blow the fist 300 will move from a rear position AR—AR all the way to a front position AF—AF shown in FIGS. 2 and 6. During the moving of the fist 300 to the front position AF—AF the elastic bands 26.1, 26.2, 26.3, 26.4, 26.5 and the three rectangular plates i.e. the rear plate 24.1, the intermediate plate 24.2 and the front plate 24.3 come into play in the following manner. The moving fist 300 will generally come into contact with the block of foam rubber 160 and then push the rear plate 24.1 forward from its inoperative position BI—BI consequently causing the elastic band 26.1 to extend and thus placed under tension to absorb some of and to reduce the impact. The moving fist 300 will keep on pushing the rear plate 24.1 forward with the elastic band 26.1 extending further. Subsequently, the rear plate 24.1 will be at the rear and next to the intermediate plate 24.2. As the fist 300 moves further towards the front position AF—AF it will now push both the rear and intermediate plates 24.1, 24.2 forward with the two elastic bands 26.2, 26.3 starting to extend and placed under tension to further absorb some of and to reduce the impact. Of course, the intermediate plate 24.2 will move forward from its inoperative position CI—CI. The fist 300 keeps moving towards the front position AF—AF until both the rear and intermediate plates 24.1, 24.2 are at the rear and next to the front plate 24.3. As the fist 300 moves further towards the front position AF—AF it will now push all three the plates 24.1, 24.2, 24.3 forward with the two elastic bands 26.4, 26.5 starting to extend and placed under tension as the front plate 24.3 moves forward from its inoperative position DI—DI to further absorb some of and to reduce the impact. Of course, all five of the elastic bands 26.1, 26.2, 26.3, 26.4, 26.5 will now be extended and under tension and absorbing most of and reducing the impact. The fist 300 will keep on pushing the three plates 24.1, 24.2, 24.3 forward until the fist 300 has reached the front position AF—AF and thus the end of its travel with the rear plate 24.1 at the position BO—BO, the intermediate plate 24.2 at the position CO—CO and the front plate 24.3 at the position DO—DO as shown in FIG. 6. It will be understood that the positions BO—BO, CO—CO and DO—DO are extreme operative positions in which the five elastic bands 26.1, 26.2, 26.3, 26.4, 26.5 are each in such a state of tension to absorb most of and drastically reduce the impact of the blow. It will further be understood that the three plates 24.1, 24.2, 24.3, while being pushed forward by the fist 300, move consecutively through a series of operative positions towards the extreme operative positions BO—BO, CO—CO and DO—DO. Although not shown in the Figures, guide means may be provided, for example in the form of a slot in each of the side strips 28.1, 28.2 for guiding protrusions extending from the respective edges 86, 88, 98, 104 of the three plates 24.1, 24.2, 24.3.

Referring to the target marking means 18 it will be understood that when the front plate 24.3 starts moving forward due to being pushed by the fist 300, the target marking means will also move forward from its inoperative position shown in FIGS. 2, 3, 4 and 5. When the front plate 24.3 moves forward the cord 215 will, of course, also move forward under influence of the two tensioned elastic bands 2 12, 2 14 thus allowing the two tensioned elastic bands 212,214 to pull the inner piece of foam rubber 202 forward thus displacing the front 220 of the inner piece of foam rubber 202 to the outside 243 of the boxing glove 10 as shown in FIG. 6. During boxing thus, the front 221 of the inner piece of foam rubber 202 being on the outside 243 comes into contact with the target to leave a mark on it. The front 221 may be provided with a suitable material, for example ink, of a specific colour which gives off against the target. This enables the boxer to see where he has struck the target.

Subsequently, when the boxing glove 10 loses contact with the target, for example when the boxer withdraws his fist 300, the elastic bands 26.1, 26.2, 26.3, 26.4, 26.5 will pull on the rear, front and intermediate plates 24.1, 24.2, 24.3 until they are in their inoperative positions BI—BI, CI—CI, DI—DI and the fist 300 in its rear position AR—AR. Of course, during this pulling, the covering 12 of the boxing glove 10 moves forward. Also the target marking means 18 will revert to its inoperative position as the front plate 24.3 moves backwards pulling on the cord 215 to relocate the inner piece of foam rubber 202 in the opening 204.

Although a preferred embodiment of the impact reducing mechanism 16 has been described in the foregoing detailed description and illustrated in the accompanying drawings it will be understood that the impact reducing means is not limited to the embodiment disclosed. For example, it is foreseeable that the function of the elastic bands 26.1, 26.2, 26.3, 26.4, 26.5 may be performed by suitable springs or even suitable hydraulic means.

Further, in the described embodiment three plates 24.1, 24.2, 24.3 are used. The applicant, however, envisages that less (or more) plates may be used, for example, only one plate namely the rear plate 24.1.

The claims which follow are to be considered an integral part of the present disclosure.

I claim:

1. A boxing glove which includes:

a covering defining a fist space which fist space allows a fist to be movable forwardly therein between a rear position and a front position when the front position of the boxing glove strikes a target; and an impact reducing mechanism including:

a frame which is generally located in the fist space and being attached to an inside of the covering;

a resilient means being operatively connected to the frame; and a first part being arranged in the fist space and being operatively connected to the frame by the resilient means such that the first part is interposed between the forwardly moving fist and the front of the boxing glove when the front of the boxing glove strikes the target, the first part being displaceable by the forwardly moving fist against the bias of the resilient means towards an operative position and being displaceable back towards its original position under influence of the resilient means.

2. A boxing glove as claimed in claim 1, in which the resilient means includes at least one elastic band which operatively interconnects the first part to the frame.

3. A boxing glove as claimed in claim 1, in which the impact reducing mechanism includes a gripping member attached to the first part which gripping member is to be gripped by a fist.

4. A boxing glove as claimed in claim 1, in which the first part is in the form of a plate which is located between the rear position of the fist and the front of the boxing glove and across the width of the boxing glove.

5. A boxing glove as claimed in claim 4, in which the plate is kept in position by means of cords which extend between a front of the frame near the front of the boxing glove and the plate each of the cords suitably knotted to the plate and the front of the frame.

6. A boxing glove as claimed in claim 4, in which the at least one elastic band extends over the front surface of the plate, over two opposite edges of the plate and then towards a rear end of the frame the ends of the at least one elastic band suitably attached to the rear end of the frame.

7. A boxing glove as claimed in claim 6, in which the plate is provided with two slots one slot next to and generally parallel to a first of the edges and the other slot next to and generally parallel to a second of the edges the at least one elastic band extending through the slots.

8. A boxing glove as claimed in claim 6, in which the frame includes two strips opposite each other extending from the front of the frame towards the rear position of the fist a first end of the elastic band suitably attached to a rear end of a first of the strips and a second end of the elastic band suitably attached to a rear end of a second of the strips.

9. A boxing glove as claimed in claim 8, in which the impact reducing mechanism includes two pouches, a first pouch fitting over the rear end of the first strip and a second pouch fitting over the rear end of the second strip, with the first end of the elastic band attached to the first pouch and the second end of the elastic band attached to the second pouch.

10. A boxing glove as claimed in claim 1, in which one of the frame and the inside of the covering is provided with a male stud and the other one of the frame and the inside of the covering is provided with a female stud, the male and female studs co-acting with each other to attach the frame to the inside of the covering in a removable manner such that the impact reducing mechanism may be removed from the boxing glove.

11. A boxing glove as claimed in claim 1, in which the impact reducing mechanism includes:

a gripping member and a plurality of first parts in the form of a front plate, an intermediate plate and a rear plate, the gripping member being attached to the rear plate and to be gripped by the fist, the three plates spaced from and generally parallel to each other and across the width of the fist space, the front plate located towards the front of the boxing glove, the rear plate located towards and in front of the rear position of the fist, the intermediate plate located between the front and the rear plates, and the resilient means includes a plurality of elastic bands each of said three plates operatively attached to the frame by means of at least one elastic band, each of said three plates displaceable by means of the forward moving fist between an inoperative position and an operative position when the front of the boxing glove strikes the target, the fist movement causing the three plates to co-act with its associated at least one elastic band which elastic band displaces its associated plate to its inoperative position after the front of the boxing glove has lost contact with the target and which resilient means allows the fist to be in the rear position after the front of the boxing glove has lost contact with the target.

12. A boxing glove as claimed in claim 1, which further includes a target marking means at least partially located in the front of the boxing glove and interconnected with the first part of the impact reducing mechanism the target marking means caused to be actuated by the forward movement of the first part when the forward moving fist displaces the first part to its operative position.

13. A boxing glove as claimed in claim 12, in which the impact reducing mechanism and the target marking means form a unit which is removable from the boxing glove to allow for repairs to the unit.

14. A boxing glove as claimed in claim 12, in which the target marking means includes a tensioned resilient means and a piece of foam rubber which piece of foam rubber is located within an opening formed in the covering the piece of foam rubber interconnected with the first part and the resilient means operatively interconnecting the piece of foam rubber with the covering which tensioned resilient means displaces a front of the foam rubber from the opening when the forward moving fist displaces the first part to its operative position.

15. A boxing glove as claimed in claim 14, in which the tensioned resilient means includes at least one elastic band.

16. A boxing glove as claimed in claim 14, in which the piece of foam rubber is located within an opening in an outer piece of foam rubber which outer piece of foam rubber snugly fits in an opening in the front of the boxing glove to form part of the covering.

17. A boxing glove as claimed in claim 16, in which the tensioned resilient means operatively interconnects the piece of foam rubber to the outer piece of foam rubber.

* * * * *